US005767808A

United States Patent [19]

Robbins et al.

[11] Patent Number: 5,767,808

[45] Date of Patent: Jun. 16, 1998

[54] MICROSTRIP PATCH ANTENNAS USING VERY THIN CONDUCTORS

[75] Inventors: William B. Robbins, Maplewood; Timothy S. Skogland, Scandia, both of Minn.

[73] Assignee: Minnesota Mining and Manufacturing Company, St. Paul, Minn.

[21] Appl. No.: 372,599

[22] Filed: Jan. 13, 1995

[51] Int. Cl.[6] ..... H01Q 1/38

[52] U.S. Cl. ..... 349/700 MS; 343/846

[58] Field of Search ..... 343/700 MS, 829, 343/830, 846, 848; H01Q 1/38

[56] References Cited

U.S. PATENT DOCUMENTS

| | | | |
|---|---|---|---|
| 3,761,937 | 9/1973 | Tricoles et al. | 343/770 |
| 4,366,484 | 12/1982 | Weiss et al. | 343/700 |
| 4,451,527 | 5/1984 | Olyphant, Jr. | 428/220 |
| 4,559,281 | 12/1985 | Derfler et al. | 428/687 |
| 4,571,592 | 2/1986 | Justice | 343/767 |
| 4,686,535 | 8/1987 | Lalezari | 343/700 |
| 4,724,443 | 2/1988 | Nysen | 343/700 |
| 4,728,962 | 3/1988 | Kitsuda et al. | 343/872 |
| 4,816,836 | 3/1989 | Lalezari | 343/700 |
| 4,864,320 | 9/1989 | Munson et al. | 343/833 |
| 4,914,445 | 4/1990 | Shoemaker | 343/700 |
| 4,963,891 | 10/1990 | Aoyagi et al. | 343/700 |
| 4,990,926 | 2/1991 | Otsuka et al. | 343/700 |
| 5,061,938 | 10/1991 | Zahn et al. | 343/700 |
| 5,105,200 | 4/1992 | Koepf | 343/700 MS |
| 5,187,490 | 2/1993 | Ohta et al. | 343/770 |
| 5,215,824 | 6/1993 | Munro, III et al. | 428/473.5 |
| 5,239,685 | 8/1993 | Moe et al. | 455/73 |
| 5,245,745 | 9/1993 | Jensen et al. | 343/700 MS |
| 5,349,288 | 9/1994 | Miller et al. | 343/700 MS |
| 5,355,143 | 10/1994 | Zurcher et al. | 343/700 |
| 5,358,926 | 10/1994 | Olson et al. | 505/210 |
| 5,367,308 | 11/1994 | Weber | 343/700 |
| 5,448,250 | 9/1995 | Day | 343/700 MS |
| 5,453,752 | 9/1995 | Wang et al. | 343/700 MS |
| 5,598,168 | 1/1997 | Evans et al. | 343/700 MS |

OTHER PUBLICATIONS

Pozar; "Microstrip Antennas"; Proceedings of the IEEE, vol. 80, No. 1, Jan. 1992; pp. 79–91.

Bhartia et al.; "Millimeter-Wave Microstrip and Printed Circuit Antennas"; 1991 Artech House, Inc.; pp. 52–55.

"Handbook of Microstrip Antennas"; vol. 2; J.R. James et al.; 1989; Peter Peregrinus Ltd.; Chapters 15 and 17.

Ramesh Garg et al., "A Thin Wall Leaky Waveguide Antenna", *IEEE Transactions on Antennas and Propagation*, vol. AP-23, No. 1, Jan. 1975.

Rainee N. Simons, "High-Temperature Superconducting Coplanar Waveguide Microwave Circuits and Antennas", *Materials Science Forum*, vol. 137–139 (1993), pp. 759–782.

Patent Abstracts of Japan, JP 7094933, Apr. 7, 1995.

*Primary Examiner*—Hoanganh T. Le

*Attorney, Agent, or Firm*—Mark J. Gebhardt; Michael K. Ouyang; Peter L. Olson

[57] ABSTRACT

A microstrip patch antenna has a first conductive layer adjacent a dielectric substrate. The first conductive layer has a thickness of less than one skin depth of the material of the first conductive layer. A second conductive layer acts as the ground plane for the first conductive layer and a feed network feeds the radiating patch of the first conductive layer.

19 Claims, 9 Drawing Sheets

MICROSTRIP PATCH ANTENNAS USING VERY THIN CONDUCTORS

FIELD OF THE INVENTION

This invention relates generally to the field of microstrip patch antennas. More particularly, this invention describes a microstrip patch antenna utilizing a conductive layer having thickness of a fraction of a skin depth of the conductive layer.

BACKGROUND OF THE INVENTION

Antennas are impedance coupling devices between free space and electronic receiving and transmitting systems. During transmission, energy from the transmitter is coupled to the antenna and caused to radiate. On reception, the antenna intercepts signals, and couples them to the receiver. Microstrip patch antennas comprise one family of hundreds of antenna families, forms and designs. Lossy cavities have been used as analytical models of microstrip patch antenngs. Cavity resonators are useful at UHF (300 MHz to 3 GHz) and microwave frequencies because ordinary lumped-parameter elements, such as resistors, inductors and capacitors, connected by wires are no longer practical as resonant circuits because the dimensions of the elements would have to be extremely small, because the resistance of the wire circuits becomes very high as a result of the skin effect, as will later be described, and because of radiation. A cavity resonator, however, alleviates these difficulties by providing conducting walls in the form of a box, for example, thereby confining electromagnetic fields inside the box. The walls of the cavity resonator provide large areas for current flow, keeping losses very small. Microstrip antennas have been analyzed as lossy cavities, where the cavity has slots approximating the dimensions of the patch from the microstrip patch antenna.

The quality factor (Q) of a resonator is defined as:

$$Q = 2\pi \frac{\text{Time-average energy stored at a resonant frequency}}{\text{Energy dissipated in one period of this frequency}}$$

The quality factor, Q, is further a measure of the bandwidth of the resonator, where Q=$f_r$/bandwidth, where $f_r$ is the resonant frequency. Losses in cavity resonators are dominated by conductivity of the metal lining the cavity, but in a typical cavity, Q is high because the cavities are closed, and lose little power from radiation. Assuming thick walled cavities, typical microwave cavity resonators have Q's that range from 3,000 to 50,000. For a spherical cavity, Q=0.725 r/δ, where δ is the skin depth and r is the cavity radius at resonant frequency ω(rad/s), and where r=2.75 c/ω where c is the speed of light. For example, a spherical cavity of thick copper which is designed to resonate at 1.0 GHz, having δ=2.06 μm and r=0.131 m, will have a quality factor Q=46,140.

Unlike resonant cavities, antennas are designed to radiate and receive power. Any antenna, including microstrip patch antennas have much lower Q due to radiative losses. In such systems having a lower Q, stored energy is lower as are circulating currents and ohmic losses. Typical patch antennas have Q's ranging from 40 to 120. The low Q of patch antennas, in comparison to that of resonant cavities, are caused by the predominant losses due to radiation. Other sources of dissipation in the antenna, such as resistive and dielectric losses in the patch antenna produce small decreases in the Q of the antenna.

The skin effect is the concentration of high frequency alternating current near surface of a conductor. The skin depth, δ, of any material is a measure of the skin effect penetration of electromagnetic fields into conductive materials. High frequency electromagnetic fields attenuate very rapidly as they penetrate into good conductors. The distance δ through which electromagnetic fields decreases by a factor of $e^{-1}$, or 36.8%, is defined as the skin depth, and is defined as:

$$\delta = \frac{2}{\sqrt{\omega\mu\sigma}}$$

where δ is the skin depth in meters, ω is the angular frequency and is defined as ω=2πf (rad/s), μ is the magnetic permeability of the material (hry/m) and σ is the electrical conductivity of the material (S/m). As frequency increases, the skin depth decreases thereby decreasing the current carried by the bulk of the material.

In cavity resonators with high Q's, as the thickness of the conductive walls become thinner and approach the thickness of one to five skin depths, the conductor losses become intolerable due to the sheet resistance of the conductors. This in turn leads to a degradation of the Q of the cavity resonator. The same logic has been applied to microstrip patch antennas. It has been generally believed that the thickness of the radiating patch element of the microstrip patch antenna must be at least one skin depth, and preferably many times the skin depth, for the antenna to have adequate performance. In Chapter 17.4 of the *Handbook of Microstrip Antennas*, James and Hall, vol. 2, (1989), fabrication of microstrip circuits and microwave antennas are described. More specifically, the book describes the requirements for both the substrate the dielectric material, and the metallization on the substrates faces. The requirements for metallization state that the metal layers deposited on the dielectric substrate must exhibit a number of characteristics, such as low resistivity and "sufficient thickness, at least three times the skin depth δ" (emphasis added) and further give an example that δ=2μm in copper at 1 GHz, such that a minimum conductor thickness for copper at 1 GHz would be 6 μm.

The conductive portions of microstrip patch antennas are typically formed from rolled copper. Rolling copper, however, presents limitations on the thickness of the copper due to process limitations. The standard thickness for rolled copper, for antenna purposes and printed circuit boards, is 35 μm. The thickness can be lowered, however to 17–18 μm, although costs mount quickly. At tremendous costs, the thickness of rolled copper can reach lower limits of 3–4 μm, although the copper becomes hard to handle and may begin to have pinholes. An alternative process for producing a thin copper layer for the conductive substrate used in a patch antenna is with electroless plated copper. In this autocatalytic process, a polymeric surface is dipped into an electroless plating bath. The previously activated surface, activated using tin chloride or platinum chloride, initiate an autocatalytic decomposition of the metal containing complex, using typically containing metals such as nickel or copper, and grows to a given thicknesses of typically less than 2 μm.

With conductor thicknesses on the order of 17 μm to 35 μm, patterning of the conductive material is typically done by photoresist and etching, considered an expensive process. Patterning may be used for producing multiple patches for an antenna pattern or for producing the interconnection traces between the multiple patches. With photoresist and etching, photoresist is deposited on the copper surface and exposed to ultraviolet radiation. After the photoresist is developed, the copper is removed by etching, dissolving the metal but not affecting the remaining photoresist, thereby producing the antenna patches and interconnection traces. This process is a relatively slow and expensive process.

SUMMARY OF THE INVENTION

To overcome the limitations in the prior art described above, and to overcome other limitations that will become apparent upon reading and understanding the present specification, the present invention provides a microstrip patch antenna having a very thin conductive layer. The microstrip patch antenna has a first conductive layer adjacent a dielectric substrate. The first conductive layer has a thickness of less than one skin depth of the material of the first conductive layer. A second conductive substrate acts as the ground plane for the radiating element of the first conductive substrate. Further, a feed network is used to feed the radiating element.

BRIEF DESCRIPTION OF THE DRAWINGS

The present invention will be more fully described with reference to the accompanying drawings wherein like reference numerals identify corresponding components, and.

DETAILED DESCRIPTION OF A PREFERRED EMBODIMENT

In the following detailed description of the preferred embodiment, reference is made to the accompanying drawings which form a part hereof, and in which is shown way of illustration a specific embodiment in which the invention may be practiced. It is to be understood that other embodiments may be utilized and structural changes may be made without departing from the scope of the present invention.

Figure 1A:
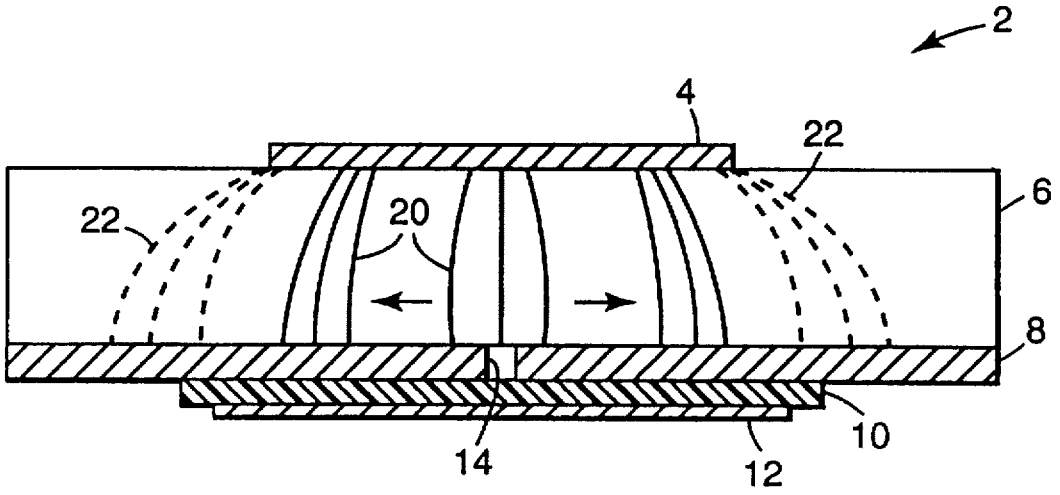
FIGS. 1*a* and 1*b* show a cross-sectional view and an exploded view, respectively, of a microstrip patch antenna of the present invention using aperture coupling to feed the radiating element.
Figure 1B:
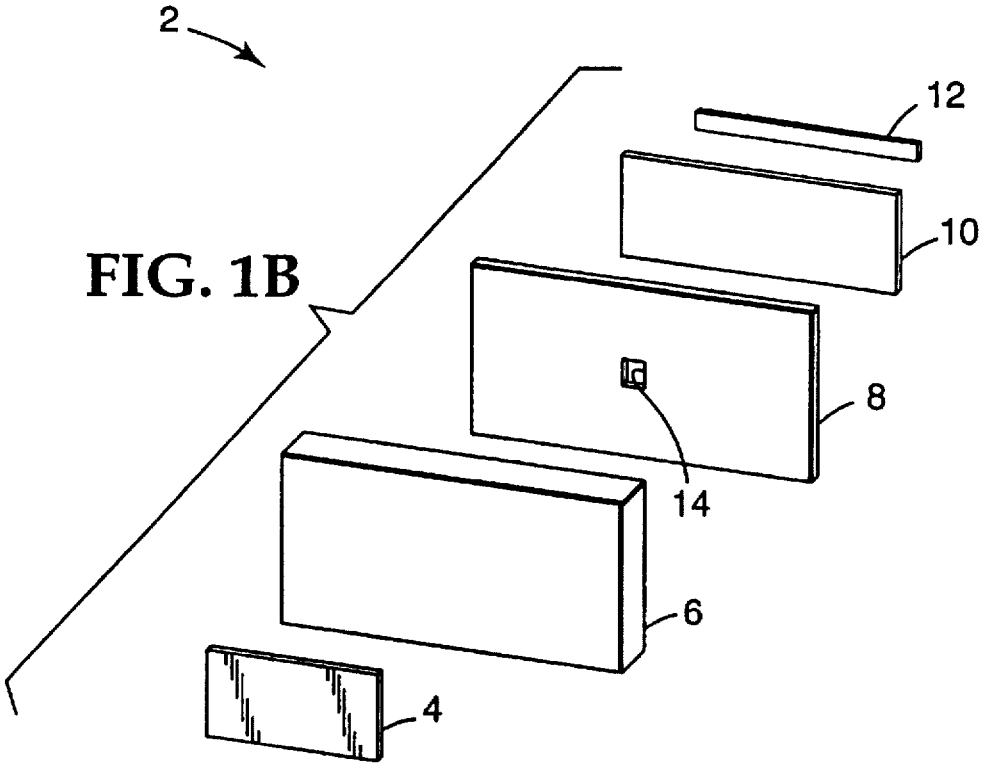

Referring to FIG. 1*a* and 1*b*, a cross-sectional view and an exploded view of microstrip patch antenna 2 is shown. Antenna 2 has a first conductive layer 4 on a first dielectric substrate 6. First conductive layer 4 is preferably copper, although any conductive metal, such as silver, aluminum, gold, platinum, titanium or aluminum, conductive oxides or conductive polymers may be used. Moreover, the conductive layer may be, for example, a uniform film or layers of the material, or transparent polymer conductors applied by a printing process such as silkscreen printing, etched or patterned grids, randomly oriented fibers or etched honeycomb structures. First dielectric substrate 6 is a low loss dielectric, preferably having a dielectric constant, $\epsilon$, between one and thirty, and more preferably between one and ten. For example, polymeric materials such as polyolefins, polyesters, polystyrenes, polyacrylates, polyurethanes an polytretrafluoroethylene mixtures as well as foamed versions of the above polymers may be used. Further, low loss ceramics and polymer-ceramic composites may be used. Specifically, Rogers RT/Duroid 5880 random fiber PTFE, having $\epsilon_r$=2.20, Rohm Rohacell 71 Polymethacrylimide foam, having $\epsilon_r$=1.14, Rogers RT/Duroid 6010.2 ceramic PTFE, having $\epsilon_r$=10.2 and Kepro FR-4 G-10 epoxy fiberglass having $\epsilon_r$=4.2 are all low loss dielectrics that could be used with the antenna of the present invention. First dielectric substrate 6 substantially performs a mechanical function, spacing first conductive layer 4 from second conductive layer 8, and therefore it is preferable that first dielectric substrate 6 has minimal energy loss.

Second conductive layer 8 acts as a ground plane for first conductive layer 4, and is preferably aluminum, although any conductive material may be used. In FIGS. 1*a* and 1*b*, while aperture coupling is used to feed first conductive layer 4, any of the feed structures well known in the antenna art may be used and are contemplated for the present invention. For example, first conductive layer 4 could be probe fed, microstrip fed, proximity coupled or a corporate feed structure could be used when multiple patches were utilized in the antenna. For aperture coupling, microstrip feed line 12 is placed on second dielectric substrate 10 and provides energy to first conductive layer Aperture 14 in second conductive layer 8 is aligned between feed line 12 and first conductive layer 4 for coupling microstrip feed line 12 with first conductive layer 4. In operation, as shown in FIG. 1*a*, when microstrip feed line 12 excites a wave in first dielectric layer 6 of microstrip patch antenna 2, waves 20 propagate in a direction parallel to feed line 12. When waves 20 reach the edges of first conductive layer 4, fringing fields 22 radiate to free space. Due to this radiation, antenna 2 has a far lower Q than a cavity resonator.

Antennas of the present invention are designed to have a broad radiation patter a low Q, lower gains and a wide bandwidth. Q may be in the range of 5 to 500, and more preferably is between 30 and 120. For a beam width of 15°, an antenna with of the present invention will exhibit gains on the order of 18 dB, and for beamwidths between 60° and 80°, a gain on the order of 6 dB. These design parameters allow the antenna of the present invention to utilize a thin conductive layer for either the first conductive layer, the ground plane or both. For example, because Q is low by design, first conductive layer 4 may be thinner, as the resistive losses in first conductive layer 4 will be small in comparison to the predominate losses due to radiation and other sources of dissipation. Further, the losses in the thin conductors, caused both by the antenna patches and the interconnection traces, if any, produce a slightly lower Q and thus a wider bandwidth, which is preferable in many situations. While the preferred thickness of first conductive layer varies with respect to the frequency, with respect to the skin depth, first conductive layer 4 preferably has a thickness of less than one skin depth, and more preferably has a thickness of 0.03 to 0.9 skin depths, and even more preferably has a thickness of 0.05 to 0.4 skin depths. For example, if copper, having a electrical conductivity of $5.91\times10^7$ S/m and a magnetic permeability, which for copper is that of free space, $\mu=\mu_0=4\pi\times10^{-7}$ hry/m, is used as first conductive layer 4, at a frequency 0.92 GHz, the skin depth is 2.16 μm. Therefore, if the thickness of the copper were 0.086 times the skin depth, the thickness of the copper, at 0.92 GHz, would be approximately 0.18 μm. This thickness of copper reduces Q by 3.2% for an antenna having a Q of 40 and by 11.3% for a Q of 120, where $Q_o$ is the Q of an antenna having very thick copper. Also, the D.C. sheet resistance of the 0.18 μm thick copper is 0.094 ohms, a small fraction of the radiation resistance of the antenna.

Due to the potential low thickness of the first conductive layer of the microstrip antenna in the present invention, processes other than the traditional processes are appropriately used to achieve the conductor thicknesses. The first conductive layer is preferably manufactured by thin-film processes. For purposes of the present specification, the term "thin-film processes" refers to the formation of films onto a supporting substrate by deposition in vacuum by electron beam evaporation, sputtering, etc. Thin-film growth on the substrate involves the formation of independently nucleated particles which grow together to form a continuous film as the deposition continues. As is well-known to those of skill in the art, the physical properties of these deposition films can be different from materials which are prepared by rolling, casting or extruding a bulk sample down to the desired thickness. For purposes of the present specification, it shall be understood that the term "thin-films" refers to films manufactured by the above defined "thin-film processes".

In thin-film processes, the thickness of the conductive layer deposited onto substrate is a function of the material deposited, the method used to deposit the material, the properties of the substrate material and the thickness of the substrate. Vacuum deposition, such as sputtering and evaporation may be used to achieve conductor thicknesses on the order of 2 to 400 nm. In an evaporation process, material to be deposited is heated in a crucible or on a bar to a temperature at which the vapor pressure of the material is high enough to evaporate material onto a facing material. Heating methods include resistive, inductive, and electron beam methods. In a sputtering process, material to be sputtered is exposed to a plasma, typically an argon plasma. The target is biased negatively with respect to the plasma, and material is removed atomically from the target by bombardment with argon ions. The target is cooled to remain at temperatures near room temperature. Both of the above processes may be performed with a reactive gas such that materials may be produced which have compositions such as oxides and nitrides.

With conductor thicknesses of less than one skin depth, a variety of alternative patterning methods not available for use with antennas having thick conductor material may be utilized for patterning the conductor. With thin-film conductive layers, processes other than etching may be used for patterning the antenna patches or interconnection traces between multiple patches that cannot be used for standard copper thicknesses of 34 μm. For example, laser ablation, flash lamp ablation, plasma ablation die cutting and electrochemical milling may be used for patterning the thin metal conductors of the present invention. For standard copper thicknesses, however, the ablation processes do not have enough available energy to wear away such substantial amounts or copper. These processes are faster and less expensive for patterning of the antenna than the photoresist and etching process needed for prior art microstrip antennas.

Figure 2:
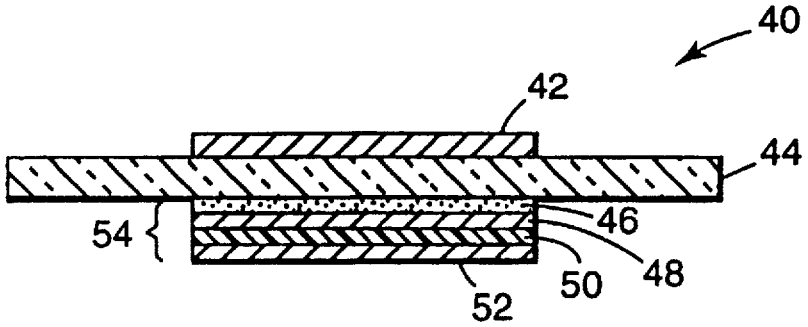
FIG. 2 ( PRIOR ART)
FIG. 2 shows a cross-sectional view of a prior art microstrip patch antenna using aperture coupling.

As mentioned earlier, the performance of antennas with conductive layers produced by thin-film processes not only perform similarly to prior art microstrip patch antennas, but have further desirable performance qualities for certain situations. FIG. 2 shows a side cross-sectional view of a prior art microstrip patch antenna. Prior art antenna 40 typically is fabricated using standard 125 mil (3.175 mm) thick Rogers RT/Duroid 5880 dielectric material 44, manufactured by Rogers Corporation, Rogers, CT, or Rohm#71, manufactured by Rohm Corporation, having a dielectric constant of 1.14. Conducting patch 42 is constructed using standard 1 oz (34 μm) rolled copper, and which typically comes pre-applied on dielectric material 44. Feed network 54 is manufactured separately and laminated to the back of dielectric material 44, such as by using pressure sensitive adhesive 46. Feed network 54 has dielectric layer 50, such as 59 mil (1.5 mm) FR4 dielectric material, such as an fiberglass epoxy circuit board, with a 50 Ohm feed line 52 fabricated on conductive layer 52, such as 1 oz (34 μm) copper. An aperture slot is cut in conductive layer 48, such as 1 oz (34 μm) copper, which acts as the ground plane for conducting patch 42. The aperture slot is aligned between conducting patch 42 and feed line 52 and provides an aperture coupled input for the antenna.

Figure 3:
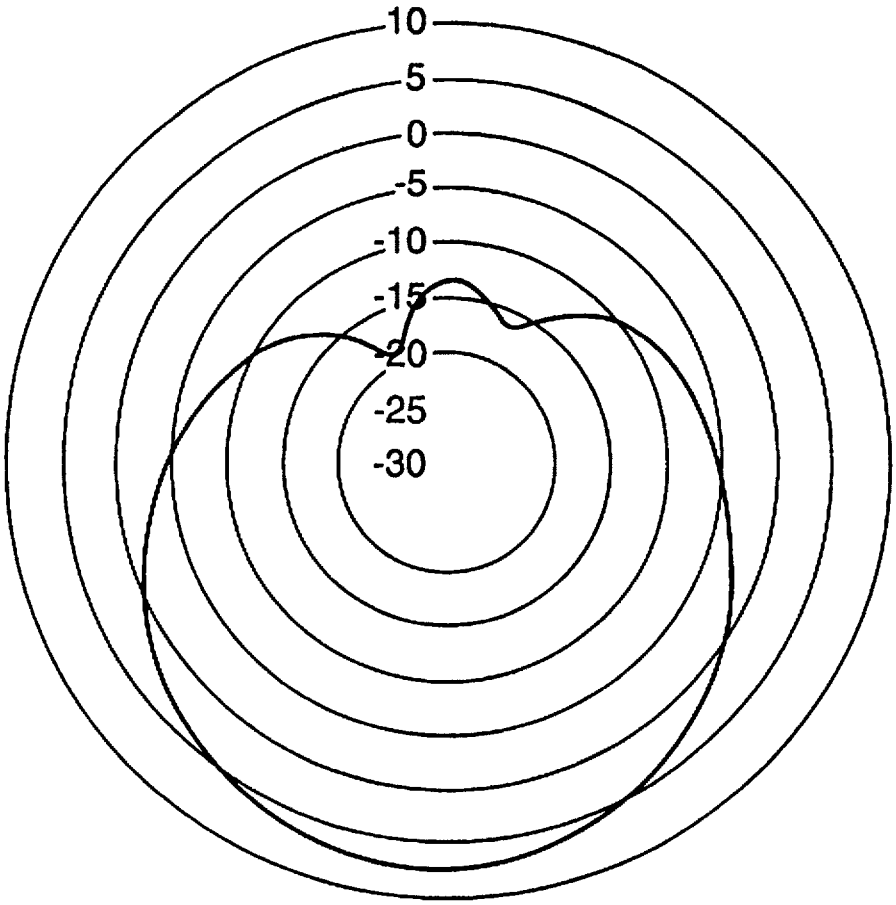
FIG. 3 shows an E-plane antenna radiation pattern for the prior art antenna FIG. 2.
Figure 4:
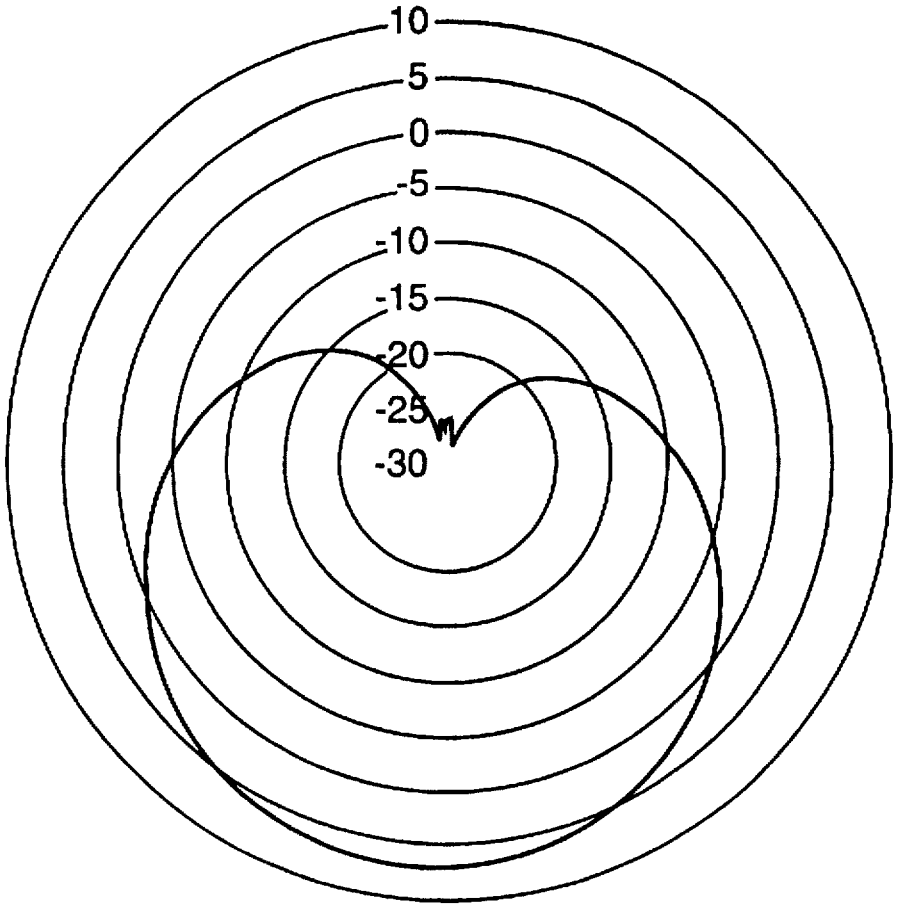
FIG. 4 shows an H-plane antenna radiation pattern for the prior art antenna FIG. 2.

FIG. 3 shows an E-plane antenna radiation pattern at 904.5 MHz for the prior art antenna shown in FIG. 2. In FIG. 3, the antenna is horizontally polarized. The antenna used to generate the antenna pattern has a single 140 mm×137 mm patch. The antenna radiation pattern shows the gain of the antenna over a 360 degree range. FIG. 4 shows an H-plane antenna radiation pattern for the same antenna. As shown in FIGS. 3 and 4, the maximum E-plane gain is 6.74 dB and the maximum H-plane gain is 6.67 dB. The maximum gains are essentially the same, the difference due to measurement tolerances of the measurement system. The beamwidth at the 3 dB half power point is 77.97 degrees in the E-plane and 79.07 degrees in the H-plane. The bandwidth for VSWR 2:1 is 9.7 MHz, making the Q of the antenna, at 904.5 MHz 93.25.

Figure 5A:
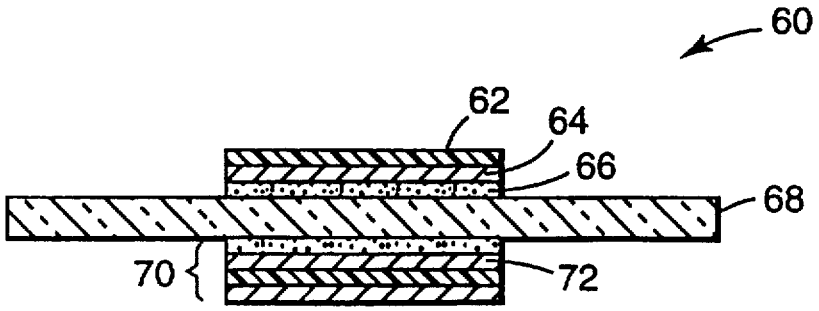
FIGS. 5*a* and 5*b* show a side cross-sectional view and an exploded view, respectively, of a microstrip patch antenna of the present invention utilizing a carrier film for the conductive radiating element.
Figure 5C:
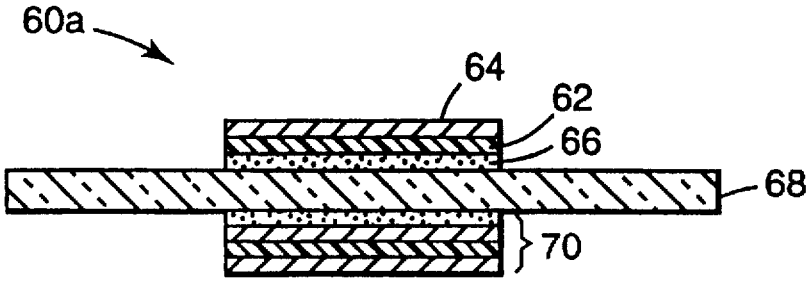
FIG. 5*c* shows a side cross-sectional view of a microstrip patch antenna of the present invention utilizing a carrier film for the conductive radiating element:, the conductive radiating element facing the dielectric layer.
Figure 5B:
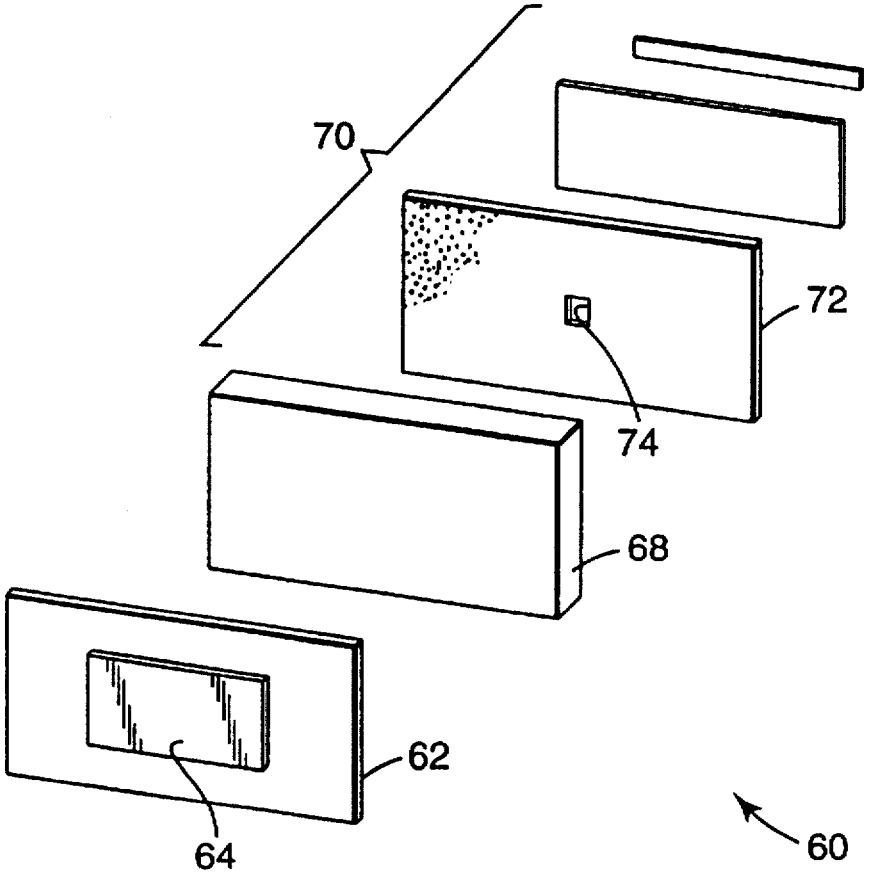

FIGS. 5*a* and 5*b* show a side cross-sectional view and an exploded view of an embodiment of the present invention. Antenna 60 is fabricated dielectric material 68, such as standard 125 mil (3.175 mm) thick Rogers RT/Duroid 5880 dielectric material. Conductive layer 64, such as copper, is deposited onto film 62 using thin-film processes such as sputtering or vapor-coating. Film 62 functions as a carrier for the conductive material in the thin-film processing. Film 62 must be able to handle the environment of the process, such as the temperatures and vacuum in a vacuum deposition process, and maintain its integrity. Film 62 may be a 50 μm clear polyester or polyimide film, such as 3M Scotchpar™ polyester. Pigmented film may also be used, such as $TiO_2$ pigmented polyester, with a 13% loading of $TiO_2$ in the polyester film. Conductive layer 64 is less than one skin depth thick, and preferably is between 0.03 to 0.9 of the skin depth of conductive layer 64 and even more preferably is between 0.05 to 0.2 of the skin depth conductive layer 64. One skin depth for copper operating at 904.5 MHz is approximately 2.17 μm. Film 62 is then laminated to dielectric material dielectric substrate 68 using adhesive 66, such as a pressure sensitive adhesive, heat activated adhesive or epoxy. Film 62 may be laminated with conductive layer 64 facing dielectric substrate 68, as shown in FIG. 5*a* and 5*b* or facing away from dielectric substrate 68, as shown in FIG.

5c. With some carrier films, the embodiment in FIG. 5c will further provide increases in the gain of antenna 60. Feed network 70, including ground plane 72, is laminated to the other side of dielectric substrate 68 and is similar to feed network 54 of antenna 40, and is preferably aperture coupled to conductive patch 64 by aligning aperture 74 between conductive patch 64 and the feed network, although other feed types may be used.

Figure 6:
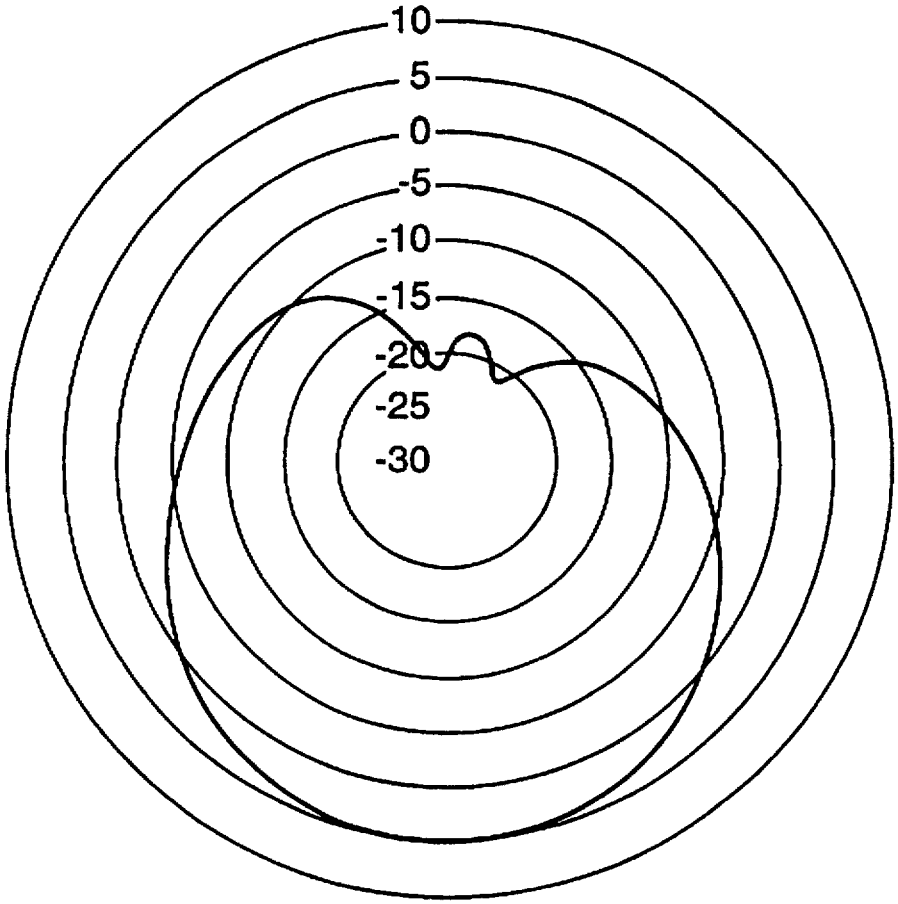
FIG. 6 shows an E-plane antenna radiation pattern for an antenna of the present invention, such as shown in FIGS. 5*a* and 5*b;*
Figure 7:
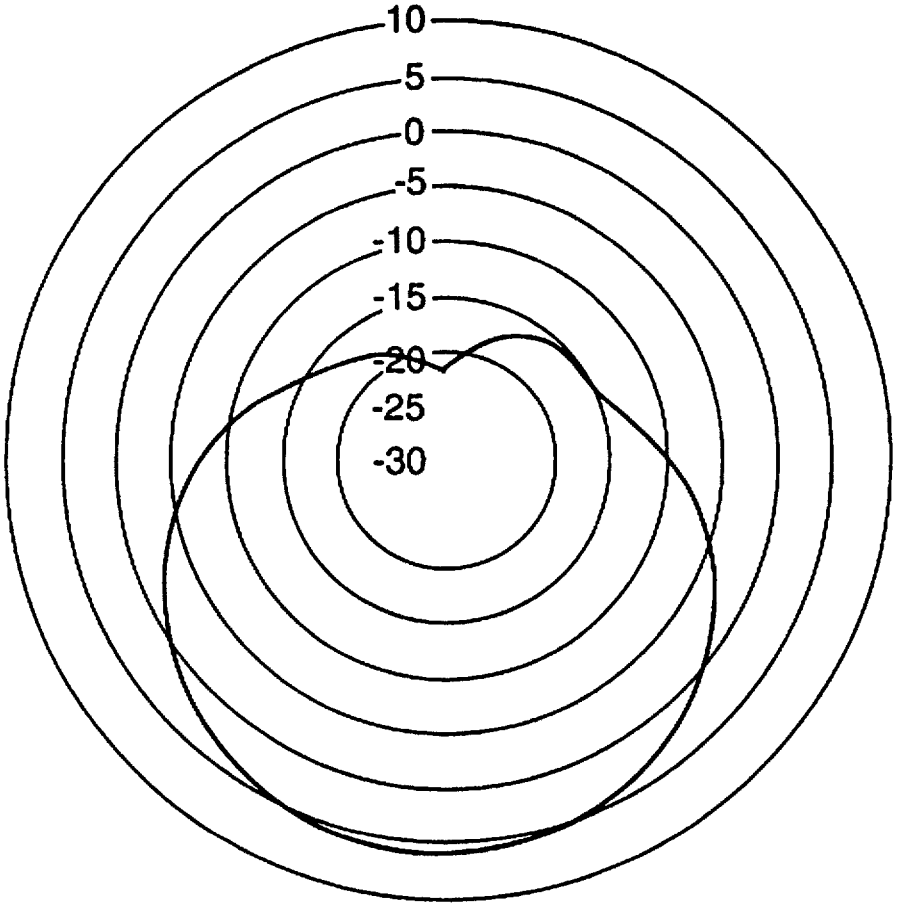
FIG. 7 shows an H-plane antenna radiation pattern for an antenna of the present invention, such as shown in FIGS. 5*a* and 5*b;*
Figure 8:
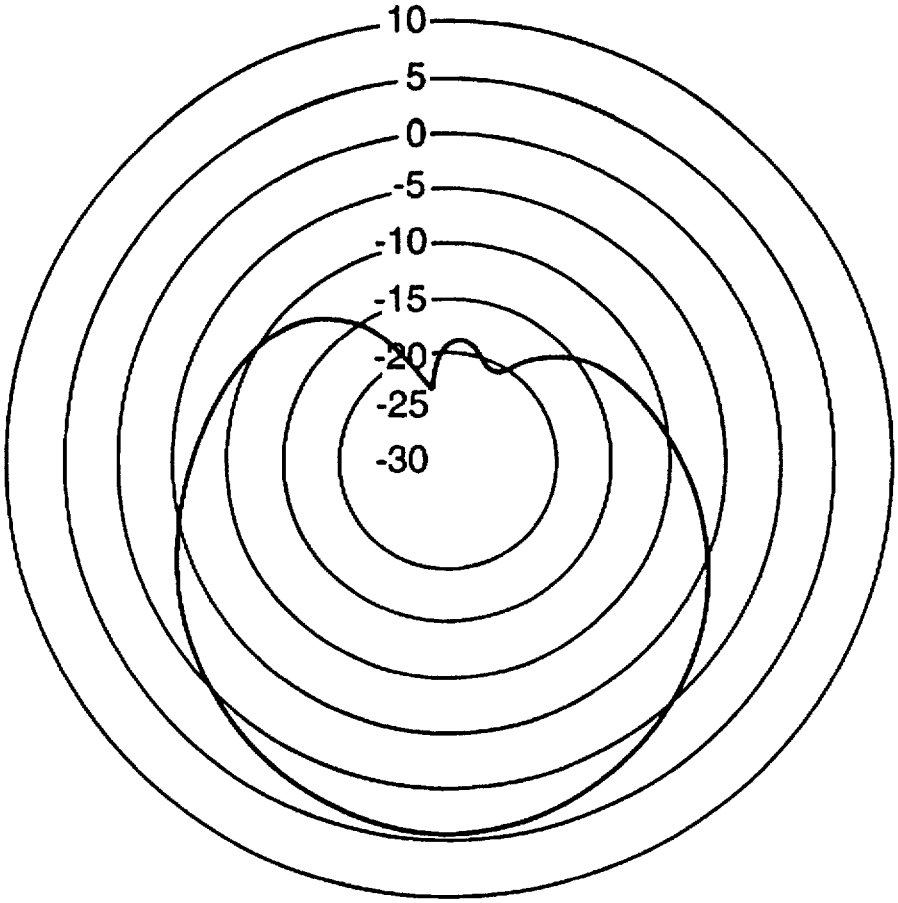
FIG. 8 shows an E-plane antenna radiation pattern for an antenna of the present invention, such as shown in FIGS. 5*a* and 5*b.
Figure 9:
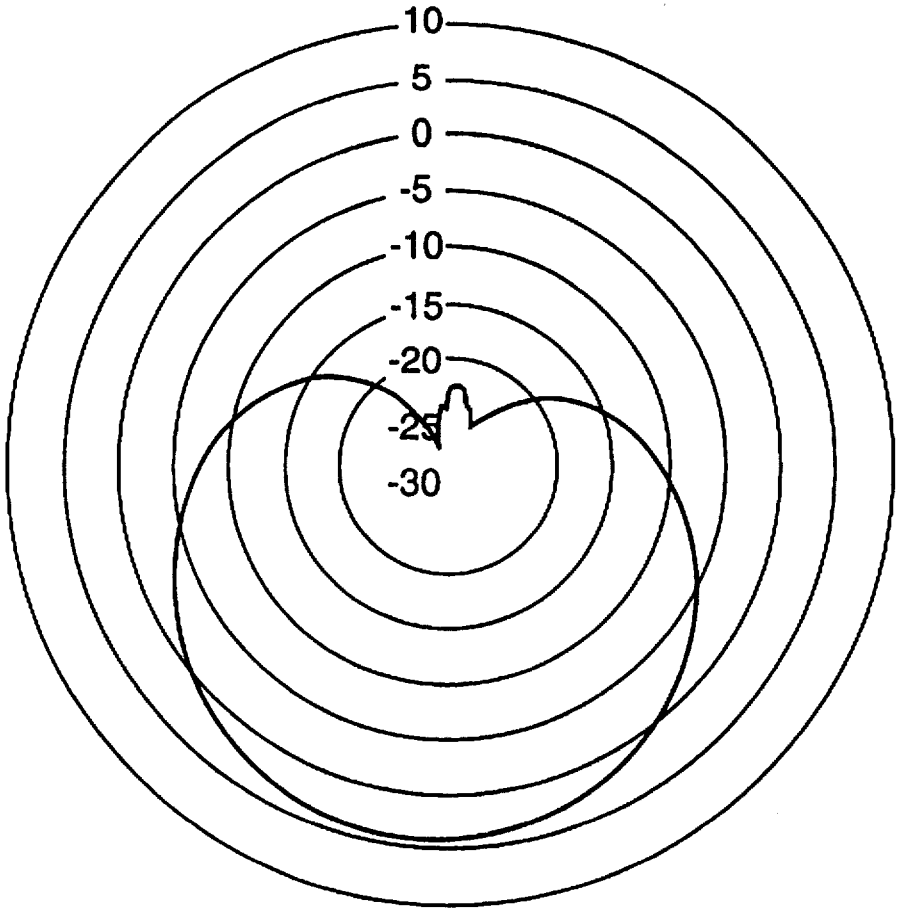
* and FIG. 9 shows an H-plane antenna radiation pattern for an antenna of the present invention, such as shown in FIGS. 5*a* and 5*b*.

FIG. 6 shows an E-plane antenna radiation pattern at 904.5 MHz for an embodiment of the present invention, such as the antenna shown in FIG. 5. The antenna used to generate the pattern in FIG. 6 has a single 140 mm×137 mm copper patch sputtered onto polyester film. The copper patch is 0.180 μm thick, or 0.083 of the skin depth of copper. FIG. 7 shows an H-plane antenna radiation pattern for the same antenna. The E-plane gain is 4.79 dB and the H-plane gain is 5.54 dB. The beamwidth in the E-plane is 78.30 degrees and in the H-plane is 79.44 degrees. The bandwidth of the antenna is 13.14 MHz. FIGS. 8 and 9 show an E-plane and H-plan antenna radiation pattern, respectively, at 904.5 MHz for an antenna similar to the antenna used to generate the pattern in FIGS. 6 and 7 except the copper patch is 0.066 μm thick, or 0.030 of the skin depth of copper. The E-plane gain is 4.05 dB and the H-plane gain is 3.77 dB. The bandwidth of the antenna is 15.52 MH.

As shown in FIGS. 3–4 and 6–9, the performance of the thin film microstrip patch antennas of the present invention perform similarly to prior art microstrip patch antennas. The basic operation of the antenna is similar, although the antennas of the present invention exhibit slightly lower gains than prior art antennas. The beamwidths are also similar. In the antennas of the present invention, however, having a conductive layer for the radiating patch of less than one skin depth in thickness results in the conductive layer exhibiting a higher resistance than prior art microstrip antennas. This higher resistance is a result of higher ohmic losses in the metallization layer of the antenna that dissipates more energy. The higher resistance lowers the Q value of the antenna, thereby increasing the bandwidth of the antennas of the present invention. Greater bandwidth is often desirable in antennas, and is particularly desirable in microstrip antennas, which are inherently narrow bandwidth antennas. The greater bandwidth in the antennas of the present invention allows them to operate over a large range of frequencies. Further, the greater bandwidth makes the antennas more tolerant to variations in manufacturing without compromising the operation of the antenna.

The antenna of the present invention exhibits further desirable physically properties. Because the thin-film processes may be used to produce both the radiating patch and the ground plane of the antenna, the conductive layers may be deposited on flexible dielectric layer, such as 50 μm thick polyolefin, to produce an antenna that flexes and is conformable. In such an embodiment, the conductor feed line must be thin. Conformability allows the antenna to be mounted on curved surfaces, thereby facilitating the installation of antennas of the present invention in a variety of locations rigid prior art antennas could not be installed. This property further facilitates production, processing and transporting the antennas.

Although a preferred embodiment has been illustrated and described for the present invention, it will be appreciated by those of ordinary skill in the art that any method or apparatus which is calculated to achieve this same purpose may be, substituted for the specific configurations and steps shown. This application is intends to cover any adaptations or variations of the present invention. Therefore, it is manifestly intended that this invention be limited only by the appended claims and the equivalents thereof.

What is claimed is:

1. A microstrip patch antenna comprising:

a first conductive layer of a conductive material having a first side and a second side;

a first dielectric layer having a first side and a second side, said second side of said first conductive layer adjacent said first side of said first dielectric layer;

a second conductive layer having a first side and a second side, said second side of said dielectric layer adjacent said first side of said second conductive layer, said second conductive layer having an aperture therethrough, said aperture aligned with said first conductive layer; and feeding means for feeding said first conductive layer;

said first conductive layer having a thickness of less than one skin depth of said conductive material of said first conductive, layer wherein said microstrip patch antenna has a quality factor of between 5 and 500.

2. The microstrip patch antenna according to claim 1, wherein said thickness of said first conductive layer is between 0.03 to 0.4 of the skin depth of said conductive material of said first conductive layer.

3. The microstrip patch antenna according to claim 1, wherein said thickness of said first conductive layer is between 0.05 to 0.2 of the skin depth of said conductive material of said conductive layer.

4. The microstrip patch antenna according to claim 1, wherein said microstrip patch antenna has a quality factor of between 5 and 120.

5. A microstrip patch antenna comprising:

a first conductive layer of a conductive material having a first side and a second side;

a first dielectric layer having a first side and a second side, said second side of said first conductive layer adjacent said first side of said first dielectric layer;

a second conductive layer having a first side and a second side, said second side of said dielectric layer adjacent said first side of said second conductive layer, said second conductive layer having an aperture therethrough, said aperture aligned with said first conductive layer;

a second dielectric layer having a first side and a second side, said second side of said second conductive layer adjacent said first side of said second dielectric layer; and a feed line adjacent said second side of said second dielectric layer;

said first conductive layer having a thickness of less than one skin depth of the conductive material of said first conductive layer, wherein said microstrip patch antenna has a quality factor of between 5 and 500.

6. The microstrip patch antenna according to claim 5, wherein said thickness of said first conductive layer is between 0.03 to 0.4 of the skin depth of said conductive material of said first conductive layer.

7. A microstrip patch antenna comprising:

a film having a first side and a second side;

first conductive material applied to said first side of said film;

a first dielectric layer having a first side and a second side, said second side of said film adjacent said first side of said first dielectric layer;

a second conductive layer having a first side and a second side, said second side of said first dielectric layer adjacent said first side of said second conductive layer, said second conductive layer having an aperture therethrough, said aperture aligned with said first conductive material; and feeding means for feeding said first conductive material;

said first conductive material having a thickness of less than one skin depth of said first conductive material;

wherein said microstrip patch antenna has a quality factor of between 5 and 500.

8. The microstrip patch antenna according to claim 7, wherein said thickness of said first conductive layer is between 0.03 to 0.4 of the skin depth of said conductive material.

9. The microstrip patch antenna according to claim 7, wherein said thickness of said first conductive material is between 0.05 to 0.2 of the skin depth of said conductive material.

10. The microstrip patch antenna according to claim 7, wherein said film is polyester.

11. The microstrip patch antenna according to claim 7, wherein said film is polyimide.

12. The microstrip patch antenna according to claim 7, wherein said film is clear.

13. The microstrip patch antenna according to claim 7, wherein said film is pigmented.

14. The microstrip patch antenna according to claim 7, wherein said second conductive layer has a thickness of less than one skin depth of the conductive material said conductive layer.

15. The microstrip patch antenna according to claim 14, wherein said thickness of said second conductive layer is between 0.03 to 0.4 of the skin depth of the conductive material of said second conductive layer.

16. The microstrip patch antenna according to claim 14, wherein said thickness of said second conductive layer is between 0.05 to 0.2 of the skin depth of the conductive material of said conductive layer.

17. A microstrip patch antenna comprising:

a film having a first side and a second side;

a first conductive material applied to said first side of said film;

a first dielectric layer having a first side and a second side, said first side of said film adjacent said first side of said first dielectric layer;

a second conductive layer having a first side and a second side, said second side of said dielectric layer adjacent said first side of said second conductive layer, said second conductive layer having an aperture therethrough, said aperture aligned with said first conductive material; and feeding means for feeding said first conductive material;

said first conductive material having a thickness of less than one skin depth of said first conductive material;

wherein said microstrip patch antenna has a quality factor of between 5 and 500.

18. The microstrip patch antenna according to claim 17, wherein said thickness of said first conductive layer is between 0.03 to 0.4 of the skin depth of said conductive material.

19. The microstrip patch antenna according to claim 17, wherein said thickness of said first conductive material is between 0.05 to 0.2 of the skin depth of said conductive material.

* * * * *

UNITED STATES PATENT AND TRADEMARK OFFICE

CERTIFICATE OF CORRECTION

PATENT NO.: 5,767,808

DATED: June 16, 1998

INVENTOR(S): William B. Robbins and Timothy S. Skogland

It is certified that error appears in the above-identified patent and that said Letters Patent is hereby corrected as shown below:

Col. 1, Line 19, "antenngs" should read - - antennas - -

Col. 1, Line 45, "is" should read - - is very - -

Col. 3, Line 30, "antenna" should read - - antenna of - -

Col. 3, Line 32, "antenna" should read - - antenna of - -

Col. 3, Line 40, "element:," should read - - element, - -

Col. 3, Line 60, "way" should read - - by way - -

Col. 3, Line 65, "FIG" should read - - FIGS - -

Col. 4, Line 13, "an" should read - - and - -

Col. 4, Line 38, "layer" should read - - layer 4. - -

Col. 4, Line 49, "patter" should read - - pattern - -

Col. 5, Line 7, "0.92" should read - - of 0.92 - -

Col. 5, Line 57, "material" should read - - materials - -

Col. 5, Line 63, "ablation" should read - - ablation, - -

Col. 6, Line 20, "FR4" should read - - FR-4 - -

Col. 6, Line 60, "depth" should read - - depth of - -

Col. 7, Line 25, "MH" should read - - $MH_Z$ - -

UNITED STATES PATENT AND TRADEMARK OFFICE

CERTIFICATE OF CORRECTION

PATENT NO.: 5,767,808

DATED: June 16, 1998

INVENTOR(S): William B. Robbins and Timothy S. Skogland

It is certified that error appears in the above-identified patent and that said Letters Patent is hereby corrected as shown below:

Col. 7, Line 44, "large" should read - - larger - -

Col. 7, Line 49, "physically" should read - - physical - -

Col. 7, Line 52, "on" should read - - on a - -

Col. 7, Line 66, "intends" should read - - intended - -

Col. 8, Line 19, ", layer" should read - - layer; - -

Col. 8, Line 53, "layer," should read - - layer; - -

Col. 9, Line 30, "said" should read - - of said - -

Signed and Sealed this

Sixth Day of April, 1999

*Attest:*

*Attesting Officer*

Q. TODD DICKINSON

*Acting Commissioner of Patents and Trademarks*